US006721974B1

(12) United States Patent
Wilkinson

(10) Patent No.: US 6,721,974 B1
(45) Date of Patent: Apr. 20, 2004

(54) SAFETY EQUIPMENT FOR BEDS

(75) Inventor: Michael Anthony Wilkinson, Littlehampton (GB)

(73) Assignee: Genie Care Ltd., West Sussex (GB)

( * ) Notice: Subject to any disclaimer, the term of this patent is extended or adjusted under 35 U.S.C. 154(b) by 153 days.

(21) Appl. No.: 10/018,231

(22) PCT Filed: Jun. 12, 2000

(86) PCT No.: PCT/GB00/02268

§ 371 (c)(1),
(2), (4) Date: Dec. 12, 2001

(87) PCT Pub. No.: WO00/76372

PCT Pub. Date: Dec. 21, 2000

(30) Foreign Application Priority Data

Jun. 14, 1999 (GB) ..... 9913852

(51) Int. Cl.[7] ..... A47C 2/08

(52) U.S. Cl. ..... 5/425; 5/427; 5/428; 5/498; 5/499

(58) Field of Search ..... 5/424, 425, 427, 5/428, 482, 496, 498, 499, 945

(56) References Cited

U.S. PATENT DOCUMENTS

| | | | | | |
|---|---|---|---|---|---|
| 2,644,173 | A | * | 7/1953 | James | 5/425 |
| 3,049,728 | A | * | 8/1962 | Lund | 5/945 X |
| 4,827,542 | A | * | 5/1989 | Kurtenbach | 5/93.1 |
| 4,873,734 | A | | 10/1989 | Pollard | |
| 5,351,348 | A | * | 10/1994 | Beger | 5/427 X |
| 5,421,046 | A | | 6/1995 | Vande Streek | |
| 5,450,641 | A | | 9/1995 | Montgomery | |
| 5,699,569 | A | * | 12/1997 | Schwarz-Zohrer | 5/945 X |

FOREIGN PATENT DOCUMENTS

| | | | | |
|---|---|---|---|---|
| DE | 3436807 A1 | * | 3/1985 | 5/945 |
| EP | 0503231 A | | 9/1992 | |
| GB | 14908 | * | 10/1898 | 5/498 |
| GB | 868320 A | | 5/1961 | |
| GB | 2326088 A | | 12/1998 | |

* cited by examiner

*Primary Examiner*—Robert G. Santos
(74) *Attorney, Agent, or Firm*—Clifford W. Browning; Woodard, Emhardt, Moriarty, McNett & Henry LLP

(57) ABSTRACT

Safety equipment for a bed includes sheeting (14) arranged to be securable to a mattress (12) and an inflatable wall structure (10) secured to the sheeting. The inflatable wall structure is arranged so as to define an upstanding wall which, in use, in an inflated condition, serves as a barrier to someone falling out of bed and as a cushion which protect an occupant of the bed from injuring themselves against the structure of the bed. The wall structure may include lengths arranged to be collapsable along lines transverse to the length to permit the wall to concertina to adopt the profile of a profiling bed.

19 Claims, 2 Drawing Sheets

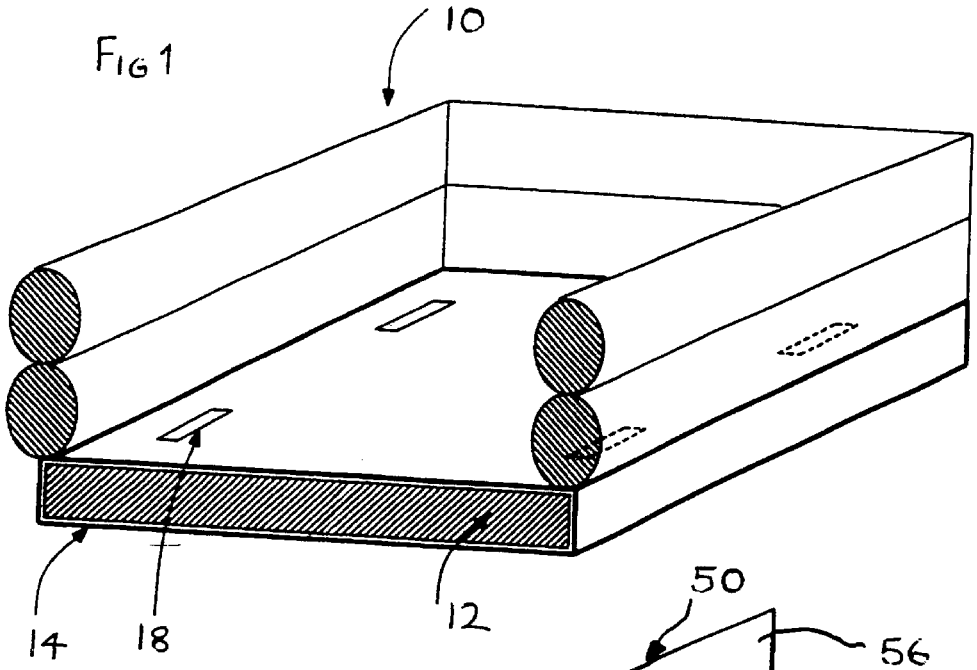
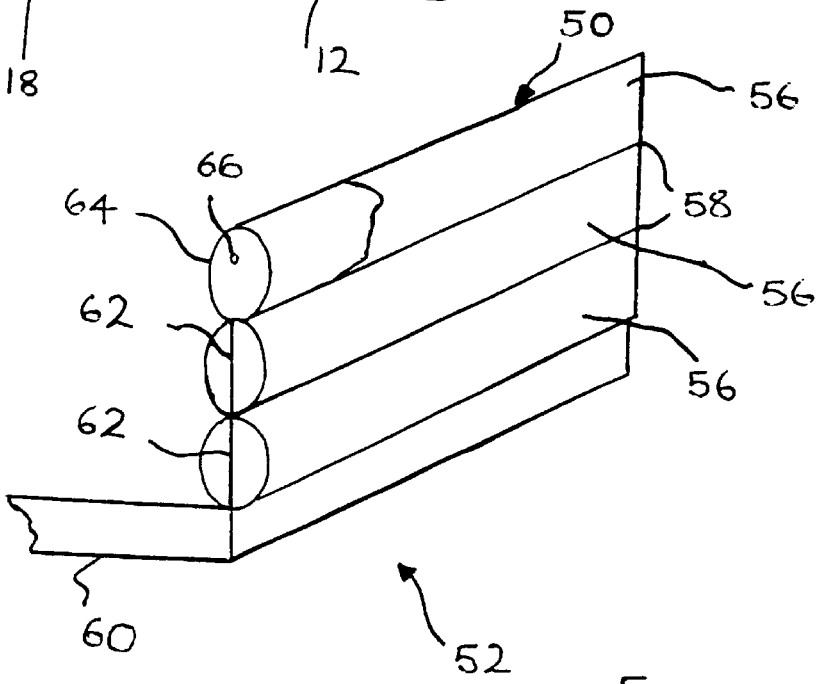
FIG 4

SAFETY EQUIPMENT FOR BEDS

This invention relates to safety equipment for beds and particularly to inflatable means for protecting the occupants of beds from self-inflicted injuries during sleep.

The problem of self-inflicted injuries during sleep by persons prone to fitting or other unconscious phenomena is well known. These injuries are usually caused by falling out of bed, becoming stuck within the surrounding solid structure of the bed or by bodily impact against the solid structure.

Attempts to prevent such injury have included many variants of inflatable or padded supports capable of fitting to, or replacing, the sides of the bed or cot so as to better absorb the impact of the body against the hard structure. An example of this type of support is known from GB2326088A which discloses inflatable tubes, or compartments, which can be fitted to a bed to prevent a person from falling out of bed or from coming into contact with the solid structure of the bed The tubes are releasably fined to the bed structure by means of ties.

However, in solving one problem, this type of solution could introduce an additional difficulty: the bed occupant becoming stuck in the gap described by the interface of the inflatable side support and the mattress.

An alternative approach disclosed in GB868320 goes some way to solving this problem of preventing the occupant from becoming stuck in the aforementioned gap, by attaching the mattress to the "safety fence" in such a manner as to eliminate the gap. However, the low sides of this safety fence are designed solely to prevent the occupant from falling out of the bed and not from sustaining injury as a result of contact with nearby solid structure during the course of a fit or other such uncontrolled body movement.

Furthermore, U.S. Pat. No. 5,421,046 discloses "bumper pads" for fitting to a child's cot with traditional solid surrounds.

It is therefore an object of the present invention to provide a means for preventing a person from falling out of bed, from coming into contact with the solid structure of the bed and from becoming trapped in the gap between the mattress and said means.

According to one aspect of this invention there is provided safety equipment for a bed including sheeting arranged to be securable to a mattress and an inflatable wall structure secured to the casing so as to define an upstanding wall arranged such that, in use, in an inflated condition, the inflatable wall structure serves as a barrier to someone falling out of bed and as a cushion which protects an occupant of the bed from injuring themselves against the structure of the bed.

The casing for the mattress may be arranged to permit a bedding sheet to be positively located thereon.

The locating means may comprise slots formed in the casing to enable elongate ties extending from said sheet to be tied around a mattress inserted in the casing.

An additional limitation of the prior art is the restricted number of suitable applications. In particular it is unsuitable for fitting to profiling beds: specially adapted beds in which the mattress-supporting frame is formed of sections which are hinged so as to allow relative pivotal movement between neighbouring sections. In this way, the bed can be operated so as to raise the occupant to a sitting position.

It is an object of the invention to provide such a bed with safety equipment which serves as a barrier to someone falling out of bed and as a cushion to protect someone in the bed from injuring themselves as a result of contact with the structure of the bed.

According to another aspect of this invention there is provided safety equipment for fitting along the sides of a frame of bed which is of the type in which the frame, which is for supporting a mattress, is formed of sections which are hinged to allow relative pivotal movement between the or each juxtaposed sections about an axis which extends from side to side of the bed, wherein the safety equipment includes lengths of inflatable wall structure, each such a length being for fitting along a respective side of a section of the frame, and angularly extensible and contractible coupling means for joining together adjacent ends of each juxtaposed pair of such lengths of inflatable wall structure either side of a hinge between juxtaposed frame sections to form a continuous wall along the respective side of the bed, the arrangement being such that the junction elements either extend or contract as appropriate with relative pivotal movement between juxtaposed bed frame sections.

The angularly extensible and contractible coupling elements may be inflatable and may be provided with controllable deflation means.

According to a further aspect of this invention there is provided a stand alone bed, especially a cot which includes a casing formed of sheet material which is adapted to receive and enclose a mattress, and inflatable wall structure secured to the casing around its periphery so as to be upstanding from that periphery when inflated whereby, when the mattress is inserted into the casing, the inflatable wall structure serves as sides and ends of the bed.

In the further aspect of the present invention, the mattress may be a cot mattress.

The invention also includes safety equipment for a hinged bed base, said equipment comprising at least one inflatable wall structure comprising at least two sections disposed in end-to-end relationship and interconnected at adjacent ends thereof by a flexible coupling so as to define a continuous wall length, wherein said sections are pivotable about an axis extending transversely of said wall length.

The invention additionally includes safety equipment for a bed, said equipment comprising an inflatable wall structure secured to sheeting, said wall structure defining an endless wall upstanding from said sheeting and comprising at least one section which has opposed ends releasably securable to adjacent portions of said wall structure whereby to define an opening in said continuous wall.

The invention further includes safety equipment for a bed which includes a frame comprising a plurality of sections arranged for relative pivotal movement about an axis extending in a widthways direction of the frame whereby said frame can define on undulant mattress supporting surface, said safety equipment comprising at least one inflatable wall structure securable to such a bed which wall structure comprises means to permit selective collapsing of said wall structure in a transverse direction thereof, whereby said wall structure can conform to said undulant surface.

In order that the invention may be well understood, some embodiments thereof, which are given by way of example only, will now be described with reference to the drawings in which:

FIG. 1 is a perspective view of an embodiment of safety equipment according to the invention, cut away to show a typical cross-section;

FIG. 4 is a perspective view of an inflatable wall structure of a fourth embodiment of safety equipment according to the invention.

FIG. 1 shows safety equipment for a bed which includes a casing 14 and inflatable wall structure 10. The casing 14 is constructed of sheet material and is adapted to receive and enclose a mattress 12. To enhance the comfort of the occupant, it is preferable that the top surface of the casing 14 be of a breathable material. The top surface of the casing 14 is provided with locating means for receiving and positively locating a bedding sheet. The locating means are slots 18 formed in the casing 14 to enable elongate ties extending from a bedding sheet to be tied around the mattress in order to secure the bedding sheet in the required position. As an alternative, the top surface of the casing may be provided with tapes to permit a bedding sheet to be secured to it by means of cooperating tapes of the hook and loop-type.

The inflatable wall structure 10 is attached to the periphery of the casing 14 so as to form a complete protective barrier consisting of four individual portions: one for each side and end of the mattress. Each portion is permanently attached to its two neighbouring portions with the exception of one side which is releasably attached to its neighbouring portions by means of hook-and-loop type tabs. As a result, it is possible to detach the aforementioned one side portion of the inflatable wall structure 10 from its neighbours and lower it independently, thereby facilitating entry and exit of the bed occupant. Alternatively, two side portions of the inflatable wall structure, preferably those extending in the lengthways direction of the bed may likewise be detachable.

Figure 2:
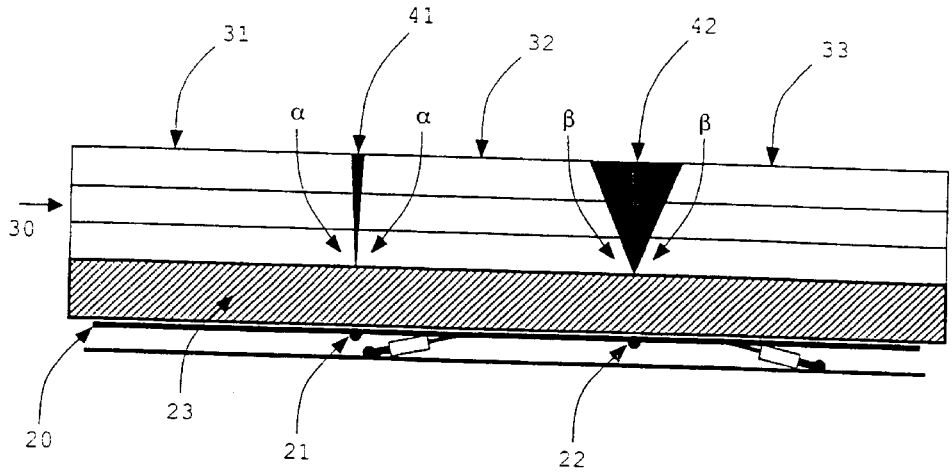
FIG. 2 illustrates a second embodiment of safety equipment according to the invention, showing a diagrammatic side view of the safety equipment as fitted to a profiling bed with the bed in the down position.

FIG. 2 shows safety equipment 30 for fining to the mattress of a profiling bed 20. As is known to someone skilled in the art, a profiling bed is constructed of sections that are hinged at 21 and 22 so as to allow relative pivotal movement between each juxtaposed pair of sections about a transverse axis of the bed. The method of attaching the safety equipment 30 to the mattress 23 is the same as that previously described with reference to FIG. 1.

In order to allow for the profiling action of the profiling bed 20, the inflatable wall structure for each side of the bed is divided into three lengths 31, 32 and 33, each such length being fitted along a respective side of a section of the bed frame. The adjacent ends of lengths 31 and 32, and lengths 32 and 33 each make acute angles $\alpha$ and $\beta$ respectively with the respective section of the bed frame in the case of the lengths 31 and 32 the acute angle a is a little less than a right angle, but for the lengths 32 and 33 the acute angle $\beta$ is less than a right angle to a greater extent.

Angularly extensible and contractible coupling means 41 and 42 are attached between lengths 31 and 32, and between lengths 32 and 33 respectively of the inflatable wall structure These coupling means are arranged such that they extend or contract as appropriate with relative pivotal movement between juxtaposed bed frame sections.

With the profiling bed 20 in the down position of FIG. 2, the first coupling means 41 is compressed by the adjacent lengths 31 and 32 to which it is attached and describes a triangle with a small angle at its base. By contrast, the second coupling means 42 is extended by the adjacent lengths 32 and 33 to which it is attached and describes a triangle with a larger angle at its base.

Figure 3:
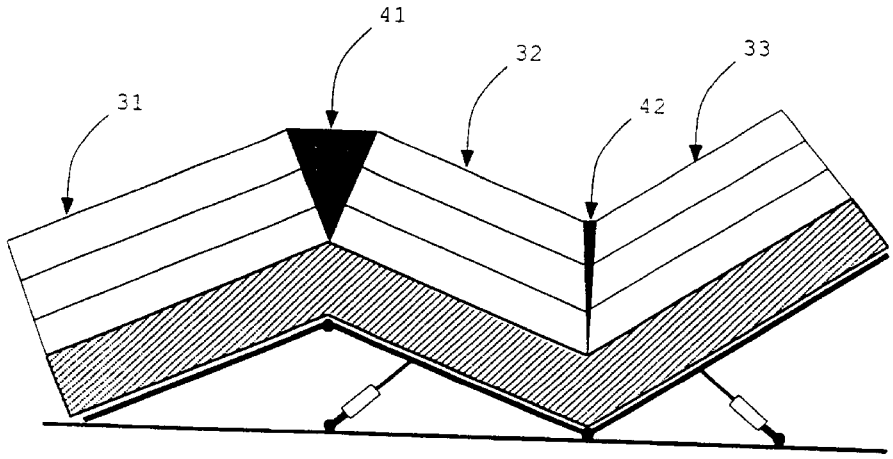
FIG. 3 is a diagrammatic side view of the safety equipment of FIG. 2 with the bed in an inclined position.

As the bed is altered from the down position of FIG. 2 to the up position of FIG. 3, the first coupling means 41 is gradually extended so as to describe a triangle with a progressively larger angle at its base, whereas simultaneously the second coupling means 42 is gradually compressed so as to describe a triangle with a progressively smaller triangle at its base.

This transition is reversed when the profiling bed is reverted back to the down position of FIG. 1.

In order to offer increased protection to the occupant of the bed when it is in either the down position of FIG. 2 or the up position of FIG. 3, it is envisaged that both the coupling means 41 and 42 are capable of being inflated. For this purpose, the coupling means may be provided with valves, indicated schematically at 44, to permit selective inflation and deflation thereof. Inflating coupling means 42 when the bed is in the down position of FIG. 2 would serve to increase the level of protection together with the rigidity of the inflatable structure 30. Whereas in the up position of FIG. 3, increased protection and rigidity could be achieved by inflating coupling means 41.

Instead of being for fitting to a bed, safety equipment shown in FIG. 1 can be used as a stand alone cot, the casing 14 being adapted to receive and enclose a cot mattress 12. The top surface of the casing 14 is provided with locating means for receiving and positively locating a child's bedding sheet. The locating means are slots 18 formed in the casing 14 to enable elongate ties extending from the bedding sheet to be tied around the cot mattress in order to secure the bedding sheet in the required position. To further enhance the comfort of the occupant, it is preferable that the top surface of the casing 14 be of a breathable material.

The inflatable wall structure 10 is attached to the periphery of the casing 14 so as to serve as sides and ends of the cot and to form a complete protective barrier consisting of four individual portions. Each portion is attached to its two neighbouring portions by means of hook-and-loop type tabs. As a result, it is possible to detach one portion of the inflatable wall structure 10 from its neighbours and lower it independently, thereby facilitating entry and exit of the infant without completely disassembling the cot wall structure 10.

FIG. 4 shows an alternative inflatable wall structure 50 which is for safety equipment 52 which can be fined to the mattress of a profiling bed such as the bed 20 shown in FIGS. 2 and 3.

The wall structure 50 comprises three outer tubes 56 disposed one above the other and welded together at 58 to define an upstanding length of wall. The lowermost tube 56 is secured to sheeting 60 which defines a casing for a mattress (not shown).

The outer tubes 56 each have a slit 62 formed at one end thereof to permit the insertion of an inner tube 64. The inner tubes 64 are inflatable by a valve 66 positioned so as to be accessible via the respective slits 62.

In use, the inner tubes 64 are inserted into the respective outer tubes 56, preferably in a partially inflated condition. The inner tubes may be fully inflated so as to fit tightly within the outer tubes and define a non-collapsable wall when the profiling bed is to be used as shown in FIG. 2. If it is desired to move the profiling bed to the position shown in FIG. 3, the inner tubes are partially deflated. This allows relative movement between the inner and outer tubes so that the wall structure 50 can concertina in response to the pivoting movement of the sections of the bed base in much the same way as the wall shown in FIG. 3.

It will be appreciated that the safety equipment 52 would comprise two wall structures 50 disposed in parallel spaced apart relationship and interconnected by inflatable endwall structures (not shown) to define an endless wall which would surround the occupant of the bed.

To permit access to the valves 66 for inflation/deflation of the inner tubes, the wall structures 50 would be releasably securable to the endwalls (for example by ties or hook and loop-type tabs). When released from the endwalls, the wall structures would be able to pivot about the joint between the lowermost tube 56 and the sheeting 60 exposing the slits 62 This arrangement also provides a means of forming an opening in the wall structure to permit the occupant easy access to the bed.

It will be appreciated that the wall structures 50 could be permanently secured to the endwalls and the inner tubes inserted into the outer tubes via slits extending in the lengthways direction of the tubes. Such slits would advantageously be closeable by means of, for example, by hook and loop type-tabs and the valve 66 would be suitably positioned along a side wall of the inner tube.

In another alternative, the outer tubes could contain a plurality of inner tubes and may be subdivided into respective compartments for the inner tubes.

Although in the embodiments, the inflatable wall structure is shown attached to a casing for a mattress, it is envisaged that the walls could be attached to a layer of sheeting and secured to a mattress by means of straps or the like.

Although in the embodiments the inflatable tubes which make up the inflatable wall structures extend horizontally, it will be appreciated that upwardly extending tubes may be utilised instead

What is claimed is:

1. Safety equipment for a bed including sheeting arranged to be securable to a mattress and an inflatable wall structure secured to the sheeting and positioned on top of said mattress so as to define an upstanding wall arranged such that, in use, in an inflated condition, the inflatable wall structure serves as a barrier to someone falling out of the bed and as a cushion which protects an occupant of the bed from injuring themselves against the structure of the bed, wherein said inflatable wall structure defines two opposed sidewalls which in use extend in a lengthways direction of the bed and two opposed endwalls interconnecting said sidewalls, wherein at least one of said sidewalls and endwalls is releasably securable at its end regions to the respective ones of the endwalls and sidewalls, whereby at least one of the sidewalls and endwalls can be released from said respective ones of the endwalls and sidewalls and pivoted relative to said casing, wherein said sheeting defines a casing for the mattress.

2. Safety equipment as claimed in claim 1, wherein said sheeting is arranged to permit a bedding sheet to be positively located thereon.

3. Safety equipment as claimed in claim 2, wherein said sheeting comprises slots formed therein to enable elongate ties extending from said bedding sheet to be tied around a mattress to which the safety equipment is secured.

4. Safety equipment as claimed in claim 1, wherein in said inflated condition, the inflatable wall structure defines a substantially continuous wall which encloses an area to be occupied by said occupant.

5. Safety equipment as claimed in claim 1, wherein said inflatable wall structure is secured to a periphery of said casing.

6. Safety equipment for a bed including sheeting arranged to be securable to a mattress and an inflatable wall structure secured to the sheeting so as to define an upstanding wall arranged such that, in use, in an inflated condition, the inflatable wall structure serves as a barrier to someone falling out of the bed and as a cushion which protects an occupant of the bed from injuring themselves against the structure of the bed, wherein said inflatable wall structure defines two opposed sidewalls which in use extend in a lengthways direction of the bed and two opposed endwalls interconnecting said sidewalls, wherein at least one of said sidewalls and endwalls is releasably securable at its end regions to the respective ones of the endwalls and sidewalls, whereby at least one of the sidewalls and endwalls can be released from said respective ones of the endwalls and sidewalls and pivoted relative to said casing, wherein said inflatable wall structure includes two portions disposed opposite one another such that, in use, each extends in a lengthways direction of the bed, each said portion comprising at least two juxtaposed sections interconnected by a respective flexible coupling member arranged such that each portion defines a continuous wall length and can pivot about an axis extending transverse to the portions and the respective flexible coupling member.

7. Safety equipment as claimed in claim 6, wherein each of said flexible coupling members is inflatable.

8. A standalone bed comprising a casing formed of sheet material which is adapted to receive and enclose a mattress, and an inflatable wall structure secured to the casing around its periphery and positioned on top of said mattress so as to be upstanding from that periphery when inflated, whereby when the mattress is inserted into the casing, the inflatable wall structure serves as sides and ends of the standalone bed wherein the inflatable wall structure that serves as one of a side and end of the bed is releasably securable to the inflatable wall structure adjacent thereto, so as to be releasable from said adjacent inflatable wall structure and pivoted relative to said casing.

9. Safety equipment for fitting along the sides of a frame of bed which is of the type in which the frame, which is for supporting a mattress, is formed of sections which are hinged to allow relative pivotal movement between juxtaposed sections about an axis which extends from side to side of the bed, wherein the safety equipment includes lengths of inflatable wall structure, each such a length of inflatable wall structure being for fitting along a respective side of a section of the frame, and the safety equipment further including angularly extensible and contractible coupling structure for joining together adjacent ends of each juxtaposed pair of such lengths of inflatable wall structure either side of a hinge between juxtaposed frame sections to form a continuous wall along the respective side of the bed, the arrangement being such that the angularly extensible and contractible coupling structure either extend or contract as appropriate with relative pivotal movement between juxtaposed bed frame sections.

10. Safety equipment as claimed in claim 9, wherein said angularly extensible and contractible coupling structure is inflatable.

11. Safety equipment as claimed in claim 9, wherein said angularly extensible and contractible coupling structure is provided with controllable deflation apparatus.

12. Safety equipment for a hinged bed base, said safety equipment comprising at least one inflatable wall structure comprising at least two sections disposed in end-to-end relationship and interconnected at adjacent ends thereof by a flexible coupling so as to define a continuous wall length, wherein said sections are pivotable about an axis extending transversely of said wall length.

13. Safety equipment as claimed in claim 12, comprising two said wall structures interconnected by sheeting and disposed in opposed spaced apart relationship.

14. Safety equipment as claimed in claim 13, wherein said sheeting defines an enclosure for a mattress.

15. Safety equipment as claimed in claim 12, comprising two said wall structures and two inflatable end wall structures interconnecting said wall structures to define a continuous enclosing wall.

16. Safety equipment as claimed in claim 15, wherein at least one of said wall structures is releasably secured to said endwall structures.

17. Safety equipment as claimed in claim 12, wherein each said flexible coupling is inflatable.

18. Safety equipment as claimed in claim 17, wherein each said flexible coupling is provided with a valve to permit controlled deflation thereof.

19. Safety equipment as claimed in claim 12, wherein each said flexible coupling is a generally V-shaped gusset.

* * * * *